United States Patent [19]

Vanderstappen

[11] 4,151,720

[45] May 1, 1979

[54] MANUALLY OPERABLE HYDRAULIC ACTUATOR

[76] Inventor: Albert W. Vanderstappen, 511 Three Oaks Rd., Cary, Ill. 60013

[21] Appl. No.: 858,647

[22] Filed: Dec. 8, 1977

[51] Int. Cl.[2] ..... F15B 13/09

[52] U.S. Cl. ..... 60/479; 60/482; 60/486; 81/301; 417/429

[58] Field of Search ..... 60/477, 478–479, 60/481, 482, 486; 74/471 R; 81/301; 417/426, 429, 533, 539

[56] References Cited

U.S. PATENT DOCUMENTS

| | | | |
|---|---|---|---|
| 1,016,692 | 2/1912 | Joyce | 60/479 |
| 2,659,307 | 11/1953 | Framhein | 60/479 X |
| 2,776,624 | 1/1957 | Reinhard | 60/481 X |
| 2,815,646 | 12/1957 | Swanson | 60/478 |
| 2,821,877 | 2/1958 | Swanson | 60/482 X |

*Primary Examiner*—Edgar W. Geoghegan

*Attorney, Agent, or Firm*—Robert L. Lindgren; Lloyd L. Zickert; Patrick T. King

[57] ABSTRACT

A manually operable hydraulic actuator which utilizes a main pump and an auxiliary pump to quickly develop a relatively large useful hydraulic force, for example, in applying compression accessories to stranded conductors such as cables. The main pump develops a relatively high pressure from a low volume of hydraulic fluid to develop the primary hydraulic force. The auxiliary pump develops a relatively low pressure from a high volume of hydraulic fluid to produce rapid advancement of a force-applying piston relative to a work piece. Both the main and auxiliary pumps are operated by the opposed swinging movement of two manually operable handles. One of the handles is selectively movable between a first position for simultaneously actuating both the main and auxiliary pumps and a second position for actuating the main pump only. A pressure relief system is provided to ensure development of the maximum rated pressure of the force-applying piston before retraction thereof can be effected.

13 Claims, 11 Drawing Figures

MANUALLY OPERABLE HYDRAULIC ACTUATOR

BACKGROUND OF THE INVENTION

This invention relates generally to hydraulic actuators and more particularly to hydraulic actuators to develop hydraulic forces for tools such as dies or dieless compressors for applying compression accessories to stranded conductors, cutting devices and the like. The hydraulic actuator of the invention utilizes a main pump and an auxiliary pump to rapidly develop a relatively large useable hydraulic force with a minimum of exertion by the operator. The main pump develops a relatively high pressure utilizing a low volume of fluid to create the primary working force, while the auxiliary pump develops a relatively low pressure with a high volume of fluid for initial rapid advancement of a working piston relative to a work piece. Both the pumps are hand operated by swinging of two handles relative to each other without changing hand positions.

Hydraulic compressing devices are known in the prior art. For example, U.S. Pat. No. 2,815,646 issued to Swanson on Dec. 10, 1957 discloses a hydraulic compression tool having a main pump which is operated by the swinging of two handles toward and away from each other for pumping fluid into the main cylinder to advance a movable die toward a fixed die to develop a compressing force. An auxiliary pump is provided in Swanson to facilitate advancement of the movable die under low pressure toward the fixed die and against the element or work piece prior to the much slower operation of the device's high pressure pump. However, in order to accomplish such advancement, devices of this type have an inherent disadvantage. An operator must continuously rotate one of the handles to operate the low pressure pump until the pre-pressing, work piece engagement of the movable die is obtained. Therefore, each time the movable die element of such device had to be advanced and/or retracted relative to a work piece through utilization of the low pressure pump, the operator had to manually rotate one of the handles with one hand in a cranking motion while gripping and supporting the device with the other hand on the other handle. Since compression tools of this type often weigh as much as twelve or more pounds and require frequent use by an operator while holding the tool above his shoulder or head level, a great deal of effort can be involved in supporting the weight of the tool with one hand by one of the handles while manually cranking the other to operate the low pressure pump prior to applying a scissors stroke to the handles to operate the high pressure pump.

Prior art devices, such as illustrated in the patent, utilized pressure relief means to relieve the substantial pressure developed during a compression operation. This enabled the operator to perform a second compressing operation provided no head adjustment was required, i.e., expansion or contraction of the die opening for various cable diameters. However, should a head adjustment be required, the operator had to resort to manual rotary cranking to effect the adjustment, a distinct disadvantage where head adjustments were required.

Another disadvantage inherent in prior art compression tools involve permanent securement of the compression head unit to the actuator body of the hydraulic device. This made interchangeability of head units for different applications impossible. Because such head units were permanently secured to the body of the actuator, the hydraulic fluid reservoir of the actuator was of a capacity sufficient only to accommodate operation of the integral head unit of the device. Therefore, use of a head unit other than that secured to the device was not intended and head units requiring greater hydraulic fluid capacities could not have been used.

SUMMARY OF THE INVENTION

Accordingly, it is an object of the invention to provide a new and improved hydraulic actuator.

It is an object of the present invention to provide a new and improved hydraulic actuator which facilitates quick operation with a material reduction in the effort required.

It is an object of the present invention to provide a hydraulic actuator having a main pump and an auxiliary pump in which both pumps are manually operated by the same swinging opposing movement of two handles relative to each other without requiring shifting of hand positions.

It is an object of the present invention to provide a hydraulic actuator wherein the volumetric capacity of the hydraulic fluid reservoir is substantially greater than the volumetric capacity of the working pressure cylinder.

It is an object of the present invention to provide a new and improved hydraulic actuator for use with a variety of head units which can be quickly removably mounted to the body of the device.

It is an object of the invention to provide a hydraulic pressure relief system which produces retraction of the work engaging piston at the conclusion of an operation with a minimum effort if the maximum rated working pressure has been developed in the actuator.

In accordance with these aims and objectives, the present invention is concerned with the provision of a hydraulic actuator which includes a body having a cylinder formed therein and a work force-applying piston slidably mounted in the cylinder. A fluid reservoir is connected in communication with the cylinder through a passage in the body. Check valves are positioned in the passage to permit fluid flow from the reservoir to the cylinder and to restrict fluid flow in the opposite direction. An elongated first handle extends axially outwardly from the body and is disposed in alignment with the axis of the piston and serves as an air-tight fluid reservoir. An auxiliary pump is provided to force hydraulic fluid under relatively low pressure from the reservoir to the cylinder to rapidly advance the piston. A main pump is provided for forcing fluids at relatively high pressure from the reservoir to the cylinder to further advance the work force-applying piston and, in turn, a relatively high hydraulic pressure to a tool such as a compression device and a work piece. A second handle is included for operation of the auxiliary and main pumps. The second handle is elongated and is pivotally connected to the body for swinging or scissors movement relative to the first elongated handle. The second handle is selectively rotatable between a first position which simultaneously operates the auxiliary pump and the main pump and a second position which operates the main pump only. At the conclusion of a force application, a finger-operated lever is provided which is easily accessible to the hand of an operator in the pumping position and which provides substantially effortless pressure release and piston retraction in preparation for a subsequent operation only if maximum rated pressure has been developed in the actuator.

The hydraulic actuator of the invention provides a greatly improved apparatus for doing a variety of jobs requiring the rapid and comfortable development of relatively high hydraulic pressures by hand operation. The subject device minimizes physical effort, excessive hand movement and the time required to complete a given job. The device is versatile in being useable with a great variety of interchangeable tool heads.

BRIEF DESCRIPTION OF THE DRAWINGS

These and other objects and advantages of the present invention will become more fully apparent from the detailed description when read in conjunction with the accompanying drawings wherein.

DESCRIPTION OF THE PREFERRED EMBODIMENT

Figures 1, 2, 3:
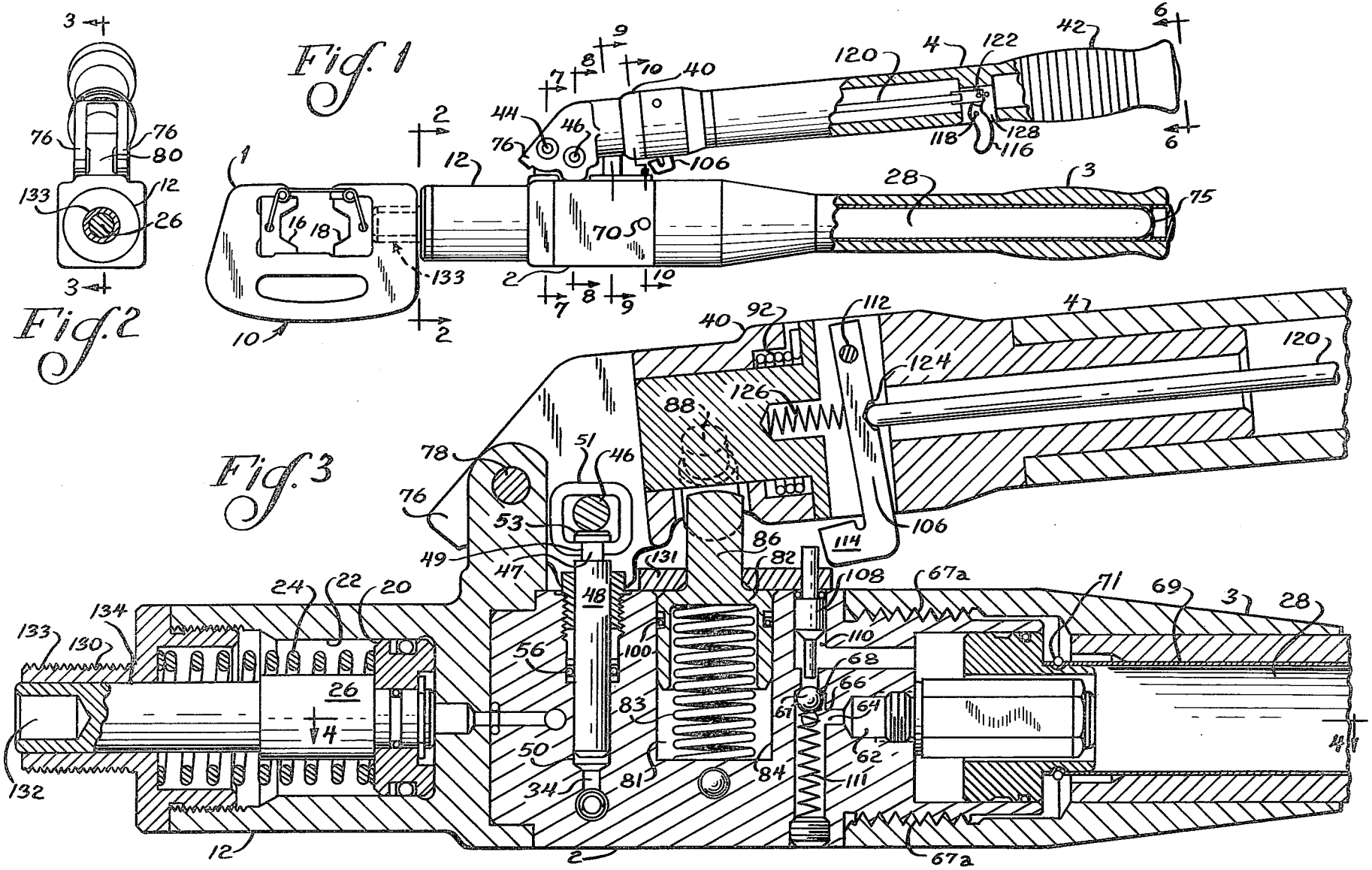
FIG. 1 is a side elevational view of a hydraulic actuator and attached compression tool embodying the present invention with some of the elements thereof being broken away and shown in partial section.
FIG. 2 is an end view taken along lines 2—2 of FIG. 1.
FIG. 3 is an enlarged fragmentary sectionalized view of the device of FIG. 1, taken along line 3—3 of FIG. 2 and illustrating various elements of the present invention.

FIG. 1 illustrates a preferred embodiment of the invention. The hydraulic actuator of FIG. 1 is normally used as a hand-operated compression tool of the type commonly used for crimping, swaging, splicing, etc. multi-stranded cables and, most frequently, in the application of a wide variety of commercially available compression accessories to various forms of stranded conductors. The actuator of FIG. 1 includes a die-operated compression head 1 which is interchangeably connected to one end of a pump body 2. In other embodiments of the invention, dieless compression heads, cutting heads and the like are interchangeably connectable to pump body 2 as an alternative to head 1.

The device illustrated in FIG. 1 includes an integral elongated handle 3 extending axially from the pump body 2. An opposed elongated second handle 4 is pivotally secured to the pump body 2 for operation of the pumps of the invention. As can be seen, the actuator of the invention appears visually to be generally similar to prior art devices; but functionally, as shall be discussed below, the device of the invention provides significant advances over such prior art.

The pump body 2 includes a cylindrical-shaped top portion 12 forming the securement base for compression head 1. The head 1 includes a fixed die element 16 and an opposed movable die element 18 which are mounted to compress a work piece therebetween. One end of the movable die element 18 is operatively linked to a force-applying piston 20 in a cylinder 22 in the top pump body section 12 which produces reciprocating movement of die 18 toward and away from the fixed die element 16. As shown in FIG. 1, the movable die element 18, upon completion of a compression operation, is designed to be normally urged into the fully retracted position shown in FIG. 3 by a coil spring 24 contained in piston cylinder 22 surrounding piston shaft 26 and biased against piston 20.

Figure 7:
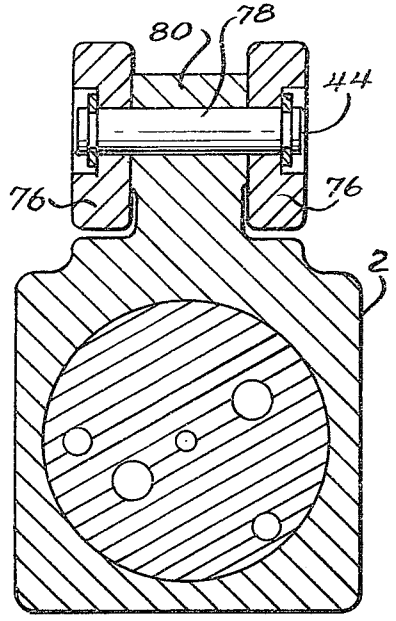
FIG. 7 is a cross-sectional view of the actuator body taken along lines 7—7 of FIG. 1.

In order to urge die element 18 into compressing relation with die element 16 while developing a hydraulic compression pressure of a magnitude of 10,000 psi to be applied to a work piece inserted between the die elements, a hydraulic fluid, such as oil, is pumped under high pressure into the cylinder 22 and behind piston 20 from an elongated, air-tight reservoir 28 contained in handle 3 by a main or high pressure pump 34 in pump body 2. Pump 34 is operated by manually operable handle 4 which is pivotably mounted to the pump body 2. As can be best seen in FIGS. 1 and 3, the movable handle 4 is provided at one end with a handle grip portion 42 while its opposite end is received in a socket-forming member 40 pivotally carried by pump body 2 at pivot 44 (see also FIG. 7). The socket-member 40 is provided with a transverse pin 46, shown in FIGS. 3 and 8, for co-operative engagement with an upper portion 47 of a piston 48 of the main pump 34. The upper shaft portion 47 of piston 48 extends exteriorly of the body 2 and projects through an opening 49 formed in a web-like structure 51 of the socketing-forming member 40. An overlying head portion 53 of piston 48 formed on the upper shaft portion 47 is disposed within the web-like structure 51 and in abutting relationship with the pin 46. The manual pivotal or scissors movement of handle 4 relative to handle 3, while maintaining engagement of pin 46 with the head portion 53 of piston 48, produces a continuous reciprocation of the piston 48 in bore 50 and pumps fluid from the reservoir 28 to displace piston 20 in the cylinder 22 at a relatively high pressure.

To pivotably mount the socket-forming member 40 on the pump body 2, a pair of ears 76, as seen in FIGS. 1, 2, 3 and 7, project generally from the socket-forming member 40 and are pivotally secured by a pin 78 which is rotatably journalled in a lug 80 formed on the pump body 2. Handle 4 can thereby be moved in an arc about pivot 44 and pin 78 relative to pump body 2 and handle 3.

Figure 4:
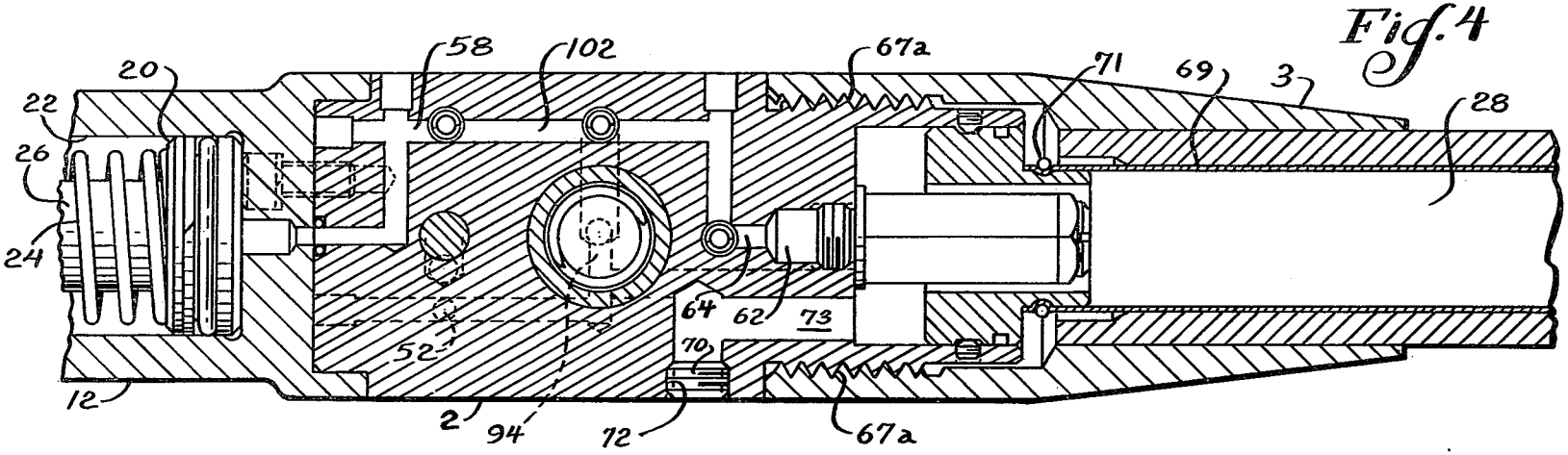
FIG. 4 is a partial sectional view of the actuator body taken along lines 4—4 of FIG. 3.

The hydraulic fluid reservoir 28 extends substantially the entire length of the hollow handle 3 and in the embodiment illustrated, the volumetric capacity of the reservoir 28 is more than 5 times the volumetric capacity of the working pressure cylinder 22 when the piston or ram 20 is in its fully extended position. As shown in FIGS. 1 and 4, hydraulic fluid may be added to the reservoir 28 by removing a plug 70 threaded in opening 72 formed in the pump body 2 and communicating with reservoir 28 through passage 73. Alternately, a filler screw (not shown) can be disposed at an end 75 of the bladder of reservoir 28 for permitting addition of hydraulic fluid.

Figure 8:
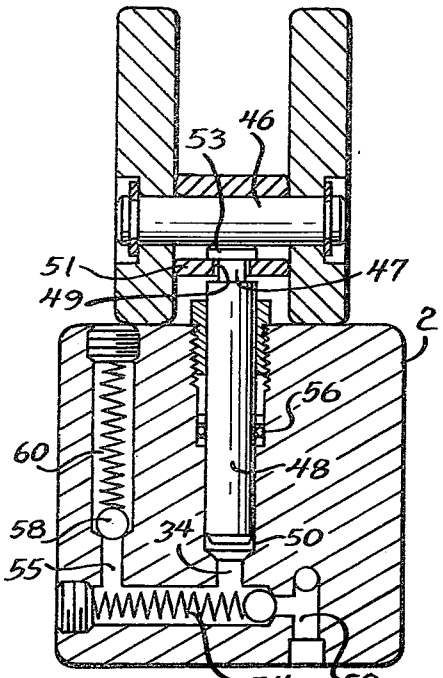
FIG. 8 is a cross-sectional view of the actuator body taken along lines 8—8 of FIG. 1.

As is best seen in FIGS. 3 and 8, the piston 48 of the main pump 34 reciprocates in a bore 50 which extends transversely through the pump body 2 and communicates with the reservoir 28 via an inlet passage 52 shown in FIGS. 4 and 8. A spring-biased ball check valve 54 is interposed in passage 52 to allow fluid to be pumped from the reservoir 28 and into passage 55 while preventing return flow of the hydraulic fluid. An O-ring seal 56 in the bore 50 acts to prevent leakage of hydraulic fluid past piston 48. The high pressure pump bore 50 operatively communicates with cylinder 22 through an outlet passage 58 (FIGS. 4 and 8) and a spring-biased ball check valve 60 connected in fluid communication with passages 55 and 52 and reservoir 28. Therefore, upon lifting of piston 48 in a pump stroke, hydraulic fluid is drawn from reservoir 28 through passage 52 and past check valve 54 into the bore 50. In the second half of the stroke as the piston 48 is depressed, hydraulic fluid is forced from the bore 50 through passage 55, past check valve 60 into passage 58 and finally into cylinder 22 behind piston 20 which is then advanced thereby.

To provide a simplified and rapid advancement of the movable die 18 to a pre-pressing position engaging the work piece, an auxiliary pump or low pressure pump 81 consisting of a piston 82 and a cylinder 84 is actuated by the opposed swinging motion of the handles 3 and 4 while permitting selective independent action of the main pump 34 as will be more fully discussed hereinafter. For actuating the piston 82 slidably mounted in the cylinder 84 formed in the body 2, the piston 82 has an end portion 86 extending outwardly of the body 2 and engageable with an actuating member 88 affixed within the socket-forming member 40. To permit selective operation of the auxiliary pump 81, the movable handle 4 is mounted in the socket-forming member 40 for rotation of about 45° with respect thereto between two preselected positions. The positions are determined by the position of the actuating member 88 within the sides of a slot 90 formed in the socket-forming member 40. The piston 82 is designed to be normally urged into its fully extended position shown in FIG. 3 by a coil spring 83 contained in the cylinder 84.

With the actuating member 88 in the position shown in phantom in FIG. 3, the member 88 will not actuate the end portion 86 of the piston 82 when the movable handle 4 is swung relative to the handle 3. While in the other position, the actuating member 88, which is shown in full in FIG. 9, will engage the end portion 86 when the handle 4 is pivoted toward the body 2 thereby actuating the low pressure pump 81. In this arrangement, it is very simple for the operator while grasping the ends of the handles 3 and 4 to select either of the two positions of the handle 4 by a mere 45° twist of the wrist and without change in gripping position. A resilient means such as a torsion spring 92 is provided in the socket-forming member 40 for normally urging the handle 4 into the relaxed or unactivated position whereby the high pressure pump 34 can be actuated only. By turning the handle 4 approximately 45° in a clockwise direction (when viewed from the end of the handle 4 until it stops, the actuating member 88 will be placed in alignment with the end portion 86 of the piston 82 so that the pumping movement of the handles 3 and 4 will result in actuation of the low pressure pump 81 in addition to the high pressure pump 34.

Figure 9:
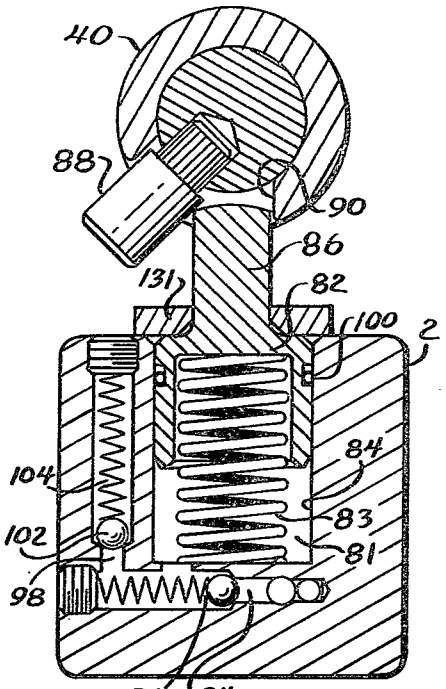
FIG. 9 is a cross-sectional view of the actuator body taken along lines 9—9 of FIG. 1.

As best seen in FIGS. 3 and 9, the piston 82 of auxiliary pump 81 reciprocates in cylinder 84 which extends transversely through the body 2 adjacent the bore 50 of high pressure pump 34. The cylinder 84 communicates with the reservoir 28 through an inlet passage 94 (FIGS. 4 and 9) and a spring-biased ball check valve 96 for permitting fluid to be pumped from the reservoir 28 to a fluid passage 98, but preventing reverse fluid flow from the passage 98 to the reservoir 28. An O-ring seal 100 is provided around the piston 82 in the cylinder 84 to prevent leakage of hydraulic fluid past the piston 82. The cylinder 84 operatively communicates with the ram or cylinder 22 through an outlet passage 102 (FIGS. 4 and 9) and a spring-biased ball check valve 104 to allow fluid flow from the passage 98 to the cylinder 22, while preventing reverse fluid flow from the cylinder 22 to the passage 98. Therefore, assuming the actuating member 88 is aligned with the end portion 86 of piston 82, the lifting of the handle 4 in a pump stroke will cause hydraulic fluid to be drawn from reservoir 28 through passage 94 and past check valve 96 into the cylinder 84. In the second half of the stroke as the piston 82 is depressed by the downward movement of the handle 4, hydraulic fluid is forced from the cylinder 84 through passage 98, past check valve 104 into passage 102 and finally into cylinder 22 behind piston 20 which is then advanced thereby.

In order to limit the maximum amount of pressure which can be developed in cylinder 22 to a pre-selected level, an automatic overload or pressure relief valve 62 (FIGS. 3 and 4) is provided to normally close a fluid passage 64 disposed to establish fluid communication between cylinder 22 and fluid reservoir 28. Therefore, after a desired maximum pressure, i.e., 10,000 psi, has been developed in the cylinder 22, any attempt to further increase the pressure will result in the opening of overload valve 62 thereby maintaining the preselected pressure maximum in the cylinder 22. The pressure limit of the relief valve 62 is infinitely adjustable to provide the desired setting. Adjustment or service of the overload valve 62 is accomplished by rotating the handle 3 (FIGS. 1 and 4) in a counter-clockwise direction, as viewed from the end of handle 3, for disengaging the threads at points 67*a* to separate the handle 3 from the pump body 2. Subsequently, a bladder 69 and an O-ring seal 71 can be removed to expose the relief valve 62 for replacement or adjustment.

Figure 10:
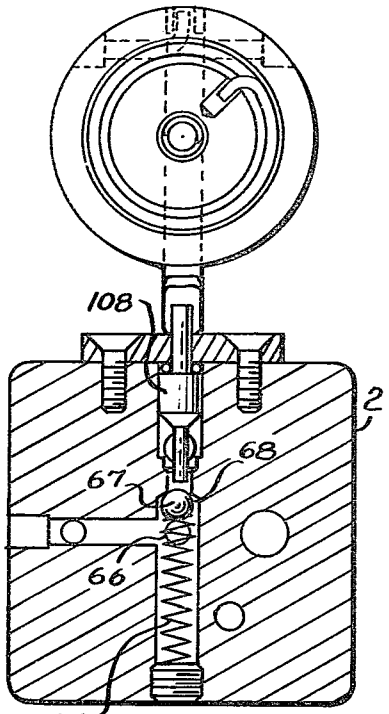
FIG. 10 is a cross-sectional view of the actuator body taken along lines 10—10 of FIG. 1.

After the desired maximum pressure has been reached, hydraulic fluid pressure in the cylinder 22 must be relieved to permit the retraction of the piston 20 from the workpiece under the force of the coil spring 24 for the next force-applying or compression operation. Fluid pressure is released from the cylinder 22 by manually opening a normally closed spring-biased, ball check valve or exhaust valve 66 which is positioned in fluid communication with passage 68 extending between the cylinder 22 and reservoir 28 (FIGS. 3 and 10). The exhaust valve 66 is designed so that it can normally only be opened with a minimum effort to allow retraction of the piston 20 after the desired maximum pressure has been developed in cylinder 22. This serves to prevent the operator from applying less than the desired maximum pre-selected pressure on a given work piece thereby ensuring that the proper pressure has been applied each and every time. Specifically, assuming that the relief valve 62 is set at 10,000 psi the ball 67 will be forced against the passage 68 with this pre-set pressure of 10,000 psi thereby maintaining the exhaust valve 66 in the closed position. Only after this pre-set pressure has been obtained in the cylinder 22 will the relief valve 62 automatically open to reduce the pressure in the passage 64 to virtually zero. Then, the ball 67 can be unseated from the passage 68 without any great effort on the part of operator. However, if the operator attempts to release the exhaust valve 66 prior to developing of the pre-set pressure in the cylinder 22 the force required to unseat the ball 67 will be much greater than what would be necessary to finish pumping the cylinder 22 to the pre-set pressure. This is because there will still be 10,000 psi of pressure in the passage 64 exerted on the ball 67 to be overcome by the operator.

The force or effort that must be applied to actuator pin 108 by the operator to unseat the ball 67 is determined in part by the size of the orifice in the passage 68 in contact with the ball 67. The increased amount of force required is directly proportional to the increased dimension of the orifice. In other words, a greater effort is needed to unseat the ball 67 in a larger orifice. The orifice in the present device has been designed to be relatively larger than the ones encountered in the prior art. Axial displacement of the actuator 108 from the fulcrum or pivot pin 78 has been found to be important in combination with the enlarged ball 67 and associated orifice in controlling opening of the exhaust valve 66. In prior art devices, the actuator was placed very close to the fulcrum point to utilize the great mechanical advantage available to enable easy opening of the exhaust valve at any time during the pumping operation.

In the embodiment illustrated, the actuator 108 has been displaced substantially farther from the fulcrum point 78 than any prior art devices now known to applicant. The effect of the displacement greatly and deliberately reduces the mechanical advantage of the lever arms causing the exhaust valve 66 to be quite difficult to open unless the relief valve 62 has been actuated by maximum pressure development. Therefore, while it is apparent in the present device that the exhaust valve 66 can be opened prior to reaching the desired maximum pressure with the application of substantial physical exertion by the operation, the unit of the invention discourages the operator from applying less than the maximum pre-selected pressure since the exertion required by the operation to force open the relief valve 66 before maximum pressure development essentially exceeds the total of the force required by the operator to continue pumping to develop maximum pressure in the pump.

In order to actuate the exhaust valve 66 through movement of the handles 3 and 4, a movable member 106 is carried in the handle 4 for selectively engaging the actuator or pin 108 which extends out of the body 2 and is reciprocable in a bore 110. In one position, the movable member 106 is disengaged so that the exhaust valve 66 is closed and actuation of the high pressure and low pressure pumps 34, 81 is permitted. In this position, the movable member 106 is capable of moving freely past the actuator 108 during the opposed swinging motions of the handles. In the other position, the member 106 is aligned and engageable with the actuator 108 during downward movement of the handle 4 so as to unseat the ball 67 away from the passage 68 to a valve open position. Once the member 106 breaks contact with the pin 108 upon lifting of the handle 4, a spring 111 yieldably urges the ball 67 back against the passage 68 thereby urging the pin 108 to an outer position in which the exhaust valve 66 is closed.

Figure 6:
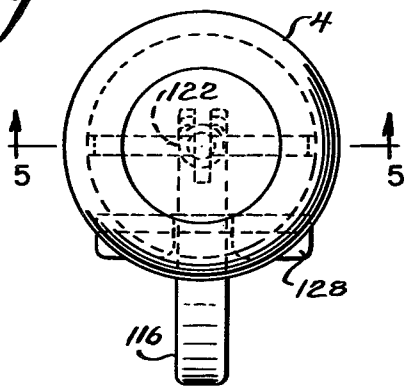
FIG. 6 is an end view of one handle taken along lines 6—6 of FIG. 1.
Figure 5:
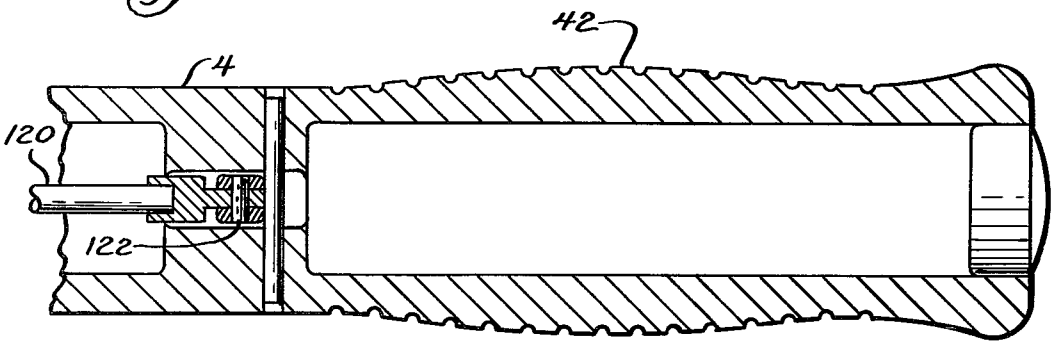
FIG. 5 is a partial sectional view of a handle end portion taken along lines 5—5 of FIG. 6.

The movable member 106 has an inner end which is pivotably connected at the point 112 on the handle 4 for swinging its outer end 114 between a first position where the member 106 is freely movable past the pin 108 and out of engagement therewith and a second position in which the end 114 is in alignment with the pin 108. The selective engagement of the movable member 106 from the first position to the second position is effected by shifting of a trigger 116 in the form of a lever fulcrumed on the handle 4 at point 118. The trigger 116 acts in co-operation with a rod 120 which is pivotably connected at point 122 on its one end to the trigger 116 and extends therefrom along the interior of the handle 4 toward the movable member 106. (FIGS. 1, 5 and 6). The trigger projects from the handle 4 and is adapted for actuation by the index finger of the hand of the operator grasping the handle 4. At the other end, the rod 120 is received in a recess 124 on one side of the mid-portion of the movable member 106. A spring 126 acts between the socket-forming member 40 and the other side of the mid-portion of the movable member 106 for urging the member 106 to its normally relaxed or unactivated position and the trigger 116 against a stop 128 on the handle 36.

In order to facilitate the interchangeability of various size head units to apply different amounts of force, the shaft 26 projects through an end section 133 formed on the top portion 12 and the end section 133 is internally threaded for mating with the head unit 1 which is internally threaded at the point 130 (FIGS. 1 and 3). The head unit 1 is simply rotated onto the end section 133. A rod 132 is operatively connected to the movable die 18 at its one end and to the shaft 26 at its other end for slidable movement in a bore 134. Thus, the head unit 1 can be readily changed by unscrewing the threaded portion in the head unit from the internally threaded end section 133.

In operation of the hydraulic actuator as illustrated in FIG. 1, it is assumed that all of the elements have been assembled and that a work piece is positioned between the fixed die 16 and the movable die 18 with the actuating member 88, the movable member 106 and the handle 36 being in their relaxed or normal positions and the movable die 18 being in the fully retracted position. The force-applying or compression operation can be understood by referring to the hydraulic schematic shown in FIG. 11. First, with the operator grasping the hydraulic actuator by the handles 3 and 4, the handle 4 is lifted away from the fixed handle 3 approximately 30° and is rotated approximately 45° in a clockwise direction, as viewed from the end of the handle 4. Then, the low pressure pump is actuated by the opposed swinging of the handles relative to each other for rapidly advancing the movable die 18 toward the fixed die 16 and against the sides of the work piece. During such movement of the handles, fluid from the reservoir 28 is transmitted through the check ball valve 96 and is, in turn, sent past the check ball valve 104 by the low pressure pump 81 to the passage 102 and cylinder 22 for movement of the die 18. It should be understood that the high pressure pump is simultaneously actuated during this movement of the handles whereby fluid from the reservoir 28 is also transmitted through the check ball valve 54 and is further delivered through the check valve 60 by the high pressure pump 34 to the passage 58 and cylinder 22 to assist in the movement of the die 18. Once the movable die 18 has been sufficiently advanced for surrounding contact relationship with the work piece, the grip on the handle 4 is momentarily relaxed to allow the handle to rotate in a counter-clockwise direction, as view from the end of the handle, to the relaxed position under the action of the spring 92 in the socket-forming member 40.

Figure 11:
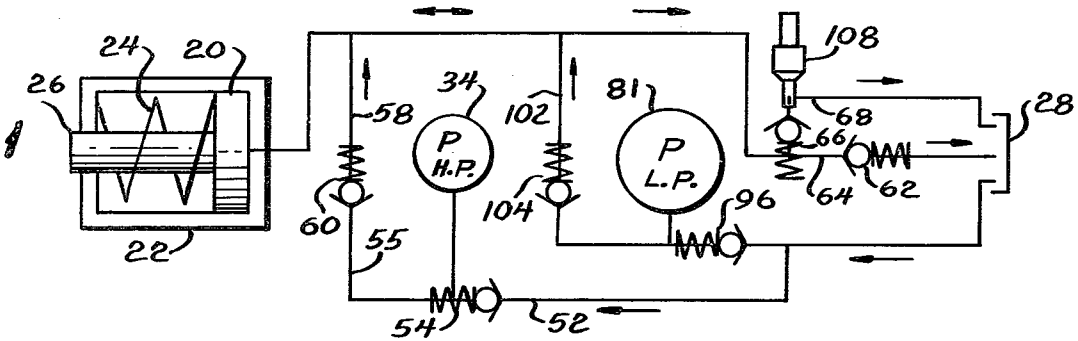
FIG. 11 is a hydraulic schematic diagram of the hydraulic actuator built according to the present invention.

Next, the handle 4 is firmly grasped by the operator and both handles are swung toward and away from each other again to further advance the movable die 18 at a slower rate by applying a high pressure through actuation of the high pressure pump 81 only. In this movement of the handles, only the high pressure pump 34 is actuated since the actuating member 88 is out-of-contact with the end portion 86 of the low pressure pump 81. With the handle 4 in this latter position, fluid from the reservoir 28 is delivered only through the check valves 54 and 60 to the passage 58 and cylinder 22. During the pumping action of the handles, the inward movement of the handle 4 is limited by the engagement of a shoulder 131 located on the exterior of the body 2. As soon as the dies 16 and 18 are closed under the predetermined pressure, the overload relief valve 62 opens to reduce the pressure in the cylinder 22 and to indicate to the operator that the force-applying operation has been completed. As can be seen in FIG. 11, once the predetermined pressure has been obtained fluid in the cylinder 22 will flow through passage 64 and relief valve 62 to reservoir 28.

In order to fully retract the movable die 18 after completion of the force-applying operation, the exhaust valve 66 is opened. This is accomplished by initially swinging the handles 3 and 4 approximately 15° apart. Then, while both hands of the operator remain in the same position on the handles, the operator moves his index finger on the handle 4 to surround the trigger 116 and pulls it towards the end of the handle 4 which raises the movable member 106 into alignment with the pin 108 adjacent the exhaust valve 66. With the trigger 116 held in this pulled position, the handles are swung together and the end portion 114 of the movable member 106 pushes the actuator 108 inwardly to unseat the movable check ball 67 sufficiently to open the fluid passage 68 (FIG. 3). This will occur essentially effortlessly if the 10,000 psi maximum pressure has been developed in cylinder 22. If not, great effort is required to unseat actuator 108. In fact, the effort required is greater than would be needed to complete development of the full rated pressure in the cylinder 22. Referring again to FIG. 11, it should be apparent that actuation of the pin 108 will cause fluid in the cylinder 22 to flow through the passage from the cylinder 22, the exhaust valve 66, and the passage 68 to the reservoir 28 thereby allowing the ram 20 to retract into the cylinder 22. The handles are maintained in this partially closed position until the cylinder 22 has fully retracted under the action of the return spring 24. Subsequently, the trigger 116 is released for movement of the movable member 106 to its relaxed position by the spring 126. The hydraulic press is now in condition for another compression operation.

From the foregoing detailed description, it can be seen that the present invention provides a new and improved hydraulic actuator which permits rapid development of relatively high hydraulic pressures in a working pressure cylinder. This is accomplished by the provision of a low pressure pump and a high pressure pump which are both actuated by opposed swinging of two handles relative to each other without requiring shifting of hand positions. Further, due to the removable mounting of the head unit to the body of the hydraulic actuator, the present actuator is very versatile for accommodating a great variety of interchangeable head units.

What is claimed is:

1. A hydraulic actuator for rapidly developing a relatively high working force comprising in combination:

body means having a cylinder formed therein and a piston slidably mounted in said cylinder;

a fluid reservoir communicating with said cylinder through a passage in said body means;

valve means disposed in said passage for permitting fluid flow from said reservoir to said cylinder and for restricting fluid flow in the opposite direction;

a first handle extending outwardly from said body means;

auxiliary pump means for forcing fluid at a relatively low pressure from said reservoir to said cylinder to rapidly advance said piston at a relatively low pressure;

second pump means for forcing fluid at a relatively high pressure from said reservoir to said cylinder to further advance said piston for a compression operation under a relatively high force;

socket means pivotably mounted on said body means;

actuating means being movably mounted in said socket means for actuating said auxiliary pump means and said second pump means, said actuating means including a second handle for opposed swinging movement relative to said first handle; and said actuating means being selectively movable between a first position for simultaneously actuating said auxiliary pump means and said second pump means and a second position for actuating said second pump means only.

2. A hydraulic actuator as claimed in claim 1, further comprises a head unit removably connected to said body means.

3. A hydraulic actuator as claimed in claim 1, further comprising means for relieving the pressure in the cylinder with a minimum effort only after a pre-selected pressure has been achieved.

4. A hydraulic actuator as claimed in claim 1, wherein the volumetric capacity of said reservoir is substantially greater than the volumetric capacity of said cylinder.

5. A hydraulic actuator as claimed in claim 1, wherein the volumetric capacity of said reservoir is more than 5 times greater than a volumetric capacity of said cylinder.

6. A hydraulic actuator as claimed in claim 2, wherein the head unit is rotatably mounted on said body means for easy disengagement.

7. A hydraulic actuator as claimed in claim 1, further comprising resilient means mounted in said socket means for maintaining said second elongated handle normally rotated into the second position.

8. A hydraulic actuator as claimed in claim 2, further comprising resilient means mounted in said socket means for maintaining said second handle normally rotated into the second position.

9. A hydraulic actuator as claimed in claim 1, wherein said auxiliary pump means comprises a low pressure pump.

10. A hydraulic actuator as claimed in claim 1, wherein said second pump means comprises a high pressure pump.

11. A hydraulic actuator as claimed in claim 3, wherein said means for relieving the pressure comprises an exhaust valve having an actuator positioned at a substantial distance from a fulcrum point thereby reducing the mechanical advantage to cause opening of the exhaust valve to be quite difficult prior to obtaining the pre-selected pressure.

12. A hydraulic actuator for rapidly developing a relatively high force comprising in combination:

body means having a cylinder formed therein and a piston slideably mounted in said cylinder;

a fluid reservoir communicating with said cylinder through a passage in said body means;

valve means disposed in said passage for permitting fluid flow from said reservoir to said cylinder and for restricting fluid flow in the opposite direction;

auxiliary pump means for forcing fluid at a relatively low pressure from said reservoir to said cylinder to rapidly advance said piston;

second pump means for forcing fluid at a relatively high pressure from said reservoir to said cylinder to further advance said piston for a compression operation under a relatively high force; and actuating means being selectively movable between a first position for simultaneously actuating said auxiliary pump means and said second pump means and a second position for actuating said second pump means only, wherein said actuating means comprises a first elongated handle and a second elongated handle adapted for opposed swinging movement relative to said first elongated handle.

13. A hydraulic actuator as claimed in claim 12, wherein said second elongated handle is movably mounted in a socket-forming member on said body means for selective movement between said first and second positions.

* * * * *